US005611361A

United States Patent [19]

Leone

[11] Patent Number: 5,611,361

[45] Date of Patent: Mar. 18, 1997

[54] MASCARA APPLICATION SYSTEM

[75] Inventor: Erlinda D. Leone, Chestnut Ridge, N.Y.

[73] Assignee: Revlon Consumer Products Corporation, New York, N.Y.

[21] Appl. No.: 490,324

[22] Filed: Jun. 14, 1995

[51] Int. Cl.[6] ..... A45D 40/26

[52] U.S. Cl. ..... 132/218; 132/317; 132/320; 132/313; 132/142

[58] Field of Search ..... 132/320, 216, 132/218, 120, 142, 313, 317; 401/35, 34; 15/167.2

[56] References Cited

U.S. PATENT DOCUMENTS

| | | | |
|---|---|---|---|
| 741,722 | 10/1903 | Ryden . | |
| 1,172,544 | 2/1916 | Metzner | 132/120 |
| 1,666,116 | 4/1928 | Bunnell . | |
| 2,022,896 | 12/1935 | Nathans . | |
| 2,136,779 | 11/1938 | Bednar | 132/218 |
| 2,323,595 | 7/1943 | Hanisch . | |
| 3,896,823 | 7/1975 | Spatz . | |
| 4,458,701 | 7/1984 | Holland . | |
| 4,545,393 | 10/1985 | Gueret . | |
| 4,600,328 | 7/1986 | Clements . | |
| 4,628,950 | 12/1986 | Bitzer | 132/218 |
| 4,632,136 | 12/1986 | Kingsford . | |
| 5,007,442 | 4/1991 | Hirzel . | |
| 5,052,839 | 10/1991 | Pettengill . | |
| 5,094,254 | 3/1992 | Krueckel et al. | 132/218 |
| 5,309,929 | 5/1994 | Toll | 132/218 |
| 5,357,987 | 10/1994 | Schrepf | 132/218 |

FOREIGN PATENT DOCUMENTS

| | | | |
|---|---|---|---|
| 776191 | 1/1935 | France | 132/218 |
| 2118436 | 11/1983 | United Kingdom | 132/218 |

*Primary Examiner*—Todd E. Manahan
*Attorney, Agent, or Firm*—Julie Blackburn

[57] ABSTRACT

A device for the application of mascara to the eyelashes comprises a wand having at one end thereof a single stem and at the other end thereof a plurality of tines. An applicator member is affixed to each tine.

18 Claims, 3 Drawing Sheets

MASCARA APPLICATION SYSTEM

TECHNICAL FIELD

The invention is in the field of brushes for application of mascara to eyelashes.

BACKGROUND OF THE INVENTION

In order to get optimal results from application of mascara, ideally each eyelash should be uniformly coated with mascara. This is rather difficult to do with current mascara application systems, which comprise only a single brush. While most women wear mascara on a regular basis, they apply the mascara only to the under surface of the lashes using an upward motion. Only a very small percentage of women apply mascara to the top of the eyelashes, thus making it difficult to achieve a uniform coating on each lash.

It is believed that most women do not apply mascara to the upper surface of the eyelashes because the current application systems make it very cumbersome. For example, if a mascara user has already curled her eyelashes, applying mascara to the lower eyelash surfaces after curling will reinforce the curl because the mascara is applied using an upward motion. However, applying mascara to the top of the eyelashes using the same brush and a downward combing motion will result in force being applied opposite to the direction of the curl, thus straightening the eyelash again. Second, it is difficult to apply mascara to the top lashes because the lashes are soft and as soon as they are touched with the brush they move away, making application of mascara difficult.

Several adaptations of mascara applicators have been designed in an attempt to counteract this approach. U.S. Pat. No. 5,007,442 teaches a mascara wand comprised of a tong shaped apparatus having an applicator member attached to the end of each arm of the tong. The tong opens and the user places the top applicator member on the top of her lashes and the bottom applicator member on the under surface of her eyelashes. The tong arms are compressed and the applicators apply mascara to the the upper and lower eyelash surfaces. The problem with this device is that tong apparatus is cumbersome and difficult to use, and the tong arms, if mishandled, can be easily poked into the eye.

U.S. Pat. No. 4,600,328 discloses a mascara application system having two brushes and two reservoirs designed to hold two portions of mascara in mutual isolation. The dual wands are simply two types of brushes for applying mascara, but do not facilitate coating of the upper and lower lashes. In addition, the dual brush construction mandates two separate cells for the mascara, which adds considerable expense in manufacturing.

U.S. Pat. No. 4,458,701 discloses a double mascara brush tongs which are designed to grasp the lashes between the arms of the tongs to apply mascara.

U.S. Pat. Nos. 2,323,595 and 2,022,896 also disclose mascara applicators having a tong-like configuration.

The current systems are unsatisfactory because they are cumbersome to use, and expensive to make. Them is thus a need for a mascara application system which makes application of mascara to upper and lower lashes simple and fast, and at the same time providing an application system which is inexpensive to manufacture.

SUMMARY OF THE INVENTION

The invention comprises a device for the application of mascara to the eyelashes comprising, in combination:

a) a wand having at one end thereof a single stem and at the other end thereof a plurality of stationary tines, b) a plurality of applicator members corresponding to the number of tines, wherein one applicator member is affixed to each tine.

The invention is also directed to a mascara application system comprising, in combination:

a) A reservoir for mascara containing one opening, b) A closure for said reservoir, said closure having an inner surface and an outer surface, c) A wand having a proximal end comprised of a single stem which is affixed to the inner surface of said closure, and a distal end comprised of a plurality of stationary fines, d) a plurality of applicator members corresponding to the number of tines, wherein one applicator member is affixed to each tine.

DETAILED DESCRIPTION

The invention is directed to a mascara applicator comprised of a single stem which diverges into a plurality of stationary or immovable tines much like those of a fork. Affixed to each of the tines is an applicator, which can be brushes, or a combination of a brush, comb, or foam.

Figure 1:
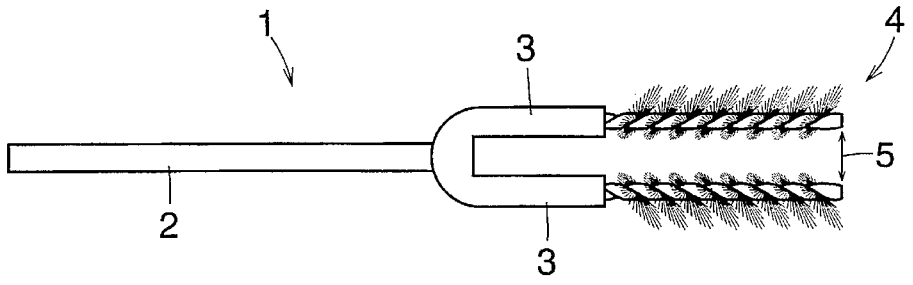
FIG. 1 depicts the mascara wand of the invention comprising a single stem which diverges into two stationary tines. The tines have affixed thereto two applicator members which are brushes.
Figure 2:
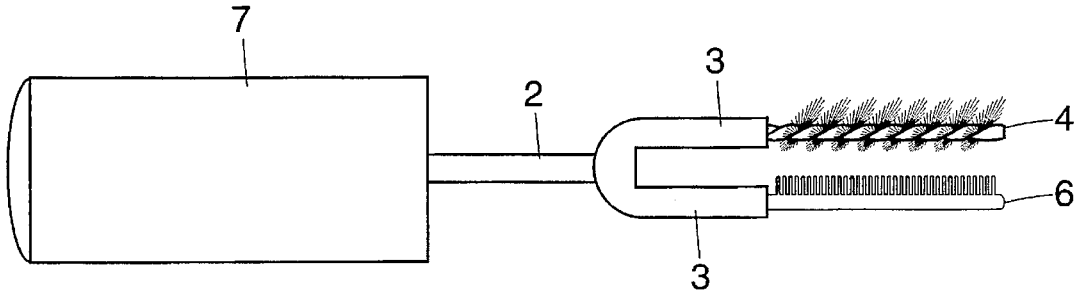
FIG. 2 depicts the mascara wand of the invention which is affixed to a closure which is designed to close the reservoir of FIG. 3. One applicator member is a brush, one applicator member is a comb.
Figure 5:
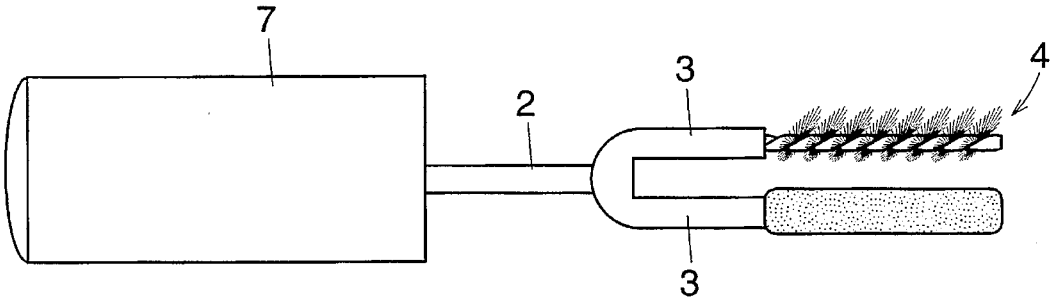
FIG. 5 depicts the mascara wand of the invention having two tines, one tine having a brush affixed thereto and the other tine having a foam affixed thereto.
Figure 4:
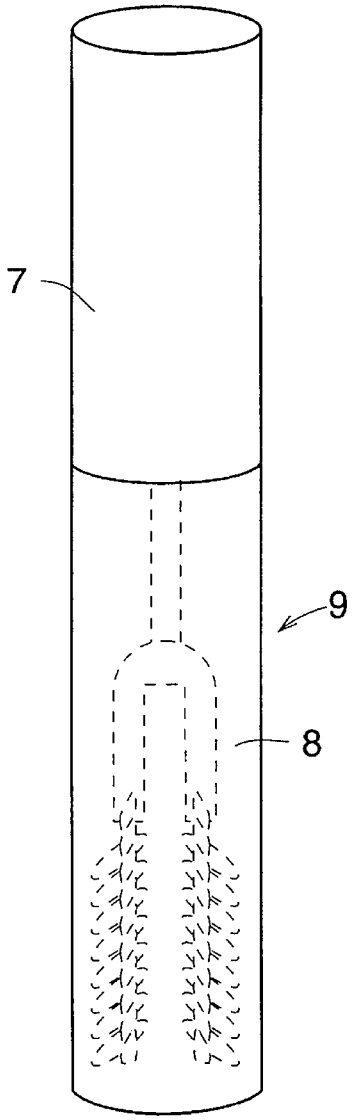
FIG. 4 depicts the mascara application system of the invention in the closed position with the closure having the wand affixed thereto in place.
Figure 3:
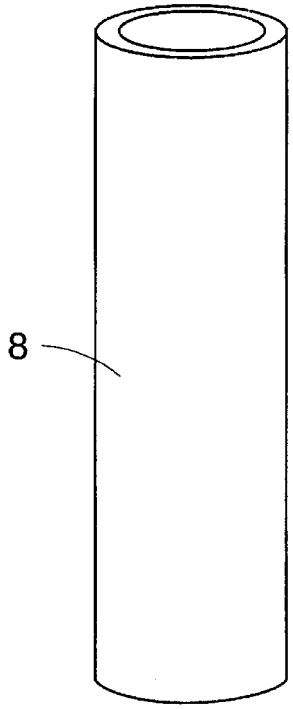
FIG. 3 depicts a reservoir containing mascara.
Figure 6:
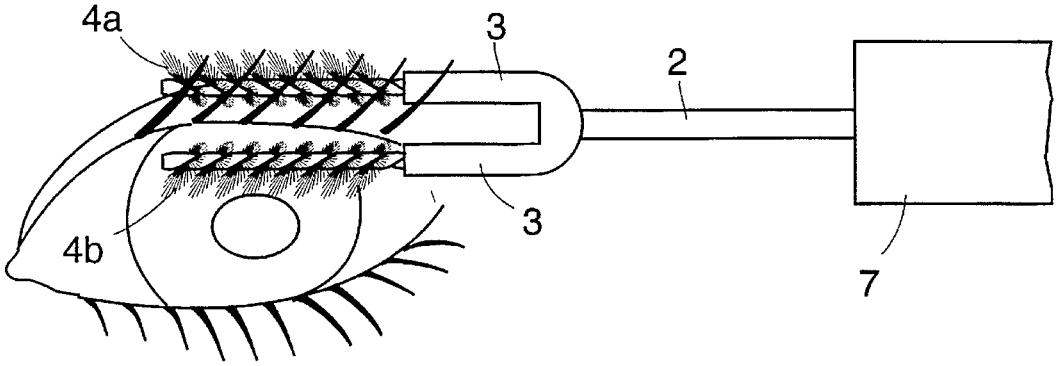
FIG. 6 illustrates how the mascara wand of the invention is used. The eyelashes are positioned between the upper and lower tines.

FIG. 1 depicts the mascara wand 1 of the invention. The proximal end of the wand is a single stem 2 and the distal end of the wand diverges into a plurality of stationary tines 3. Each tine 3 has affixed thereto an applicator member 4 which may be a brush, a comb, or a foam. The tines 3 are spaced apart a distance 5 which is sufficiently large to permit the eyelashes of the user to be inserted in between said upper applicator members **4*a* and said lower applicator member 4*b* as illustrated in FIG. 6. Generally the tines are spaced so that when the mascara is applied using a rotating upward motion which is accomplished by turning the wand about a quarter turn up, the upper applicator 4*a* applies mascara to the upper lashes and the lower applicator 4*b* applies mascara to the lower lashes. In addition, the proper spacing of the upper and lower applicator members will cause the eyelashes to cud. Generally the distance between the applicator members should be about 0.10 to 0.50 inch, with 0.25 inch being optimal. FIG. 2 illustrates one embodiment of the invention where one applicator member 4 is a brush and one applicator member is a comb 6. The single stem 2 of the wand is affixed to a closure 7 such that when the closure 7 is used to close the reservoir 8 as depicted in FIG. 3. The stationary tines 3 having the applicators 4 affixed thereto are submerged deep within the reservoir 8, into the fluent mascara contained therein. FIG. 4 illustrates a mascara application system 9 according to the invention in the closed position where the closure 7 having the wand 1 affixed thereto is affixed to to the reservoir 8, and the stationary tines 3 having the applicators affixed thereto 4 are submerged into the fluent mascara found within the reservoir. FIG. 5 illustrates an embodiment of the invention wherein one applicator member 4 is a brush, and one applicator member 4 is a foam pad. Preferably the stem 2** is 1 to 2 inches in length and the tines 0.1 to 1.0 inch in length.

Figure 7:
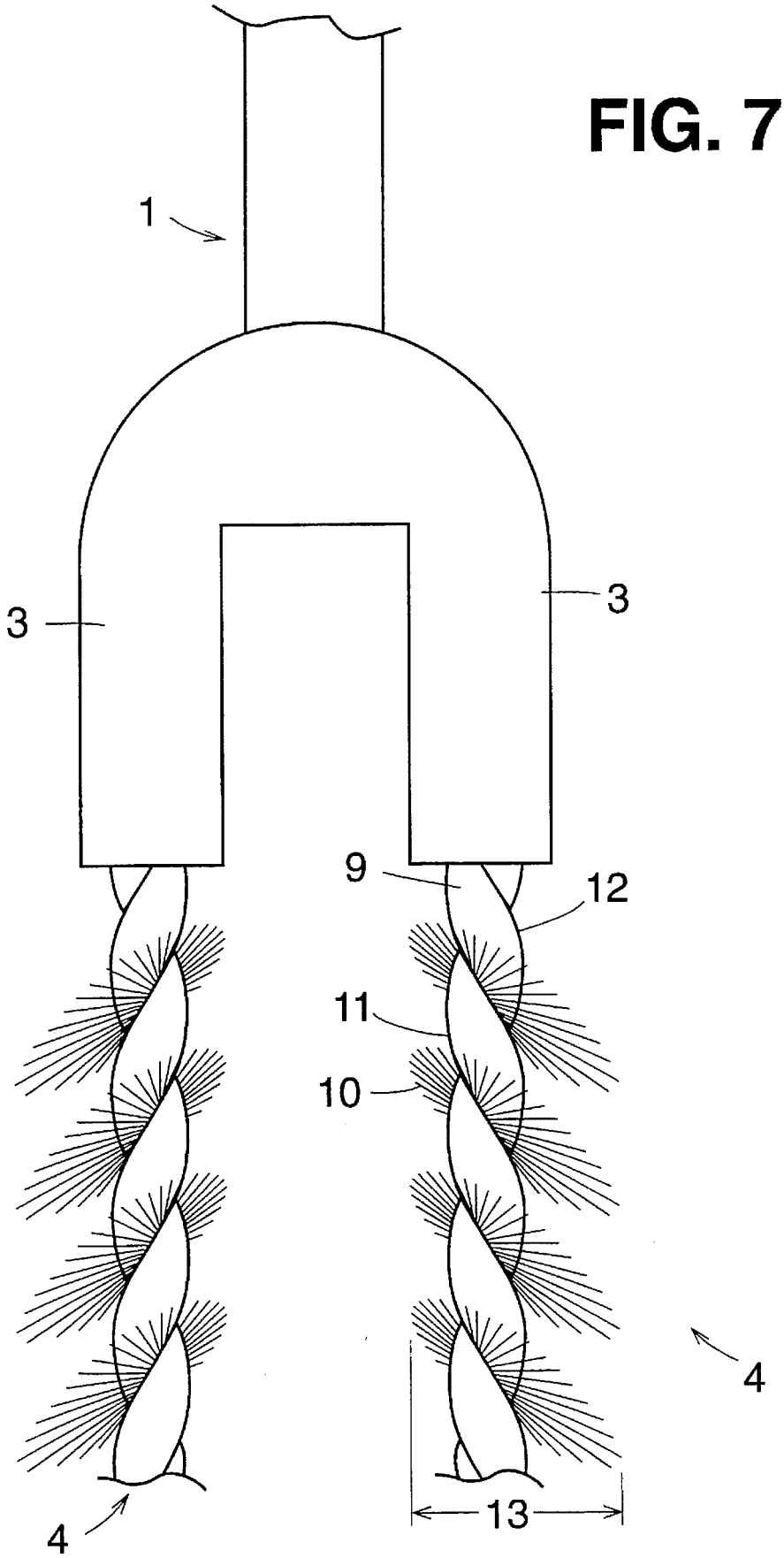
FIG. 7 is an enlarged view of the the wand of the invention wherein the applicator members are made from brushes formed from twisted metal wire.

FIG. 7 illustrates an enlarged view of a wand comprising the preferred embodiment of the invention. The wand 1 comprises two tines 3 having two applicator members 4 which are brushes. The brushes are made of metal wires twisted together 9, having disposed therebetween bristles 10. The bristles 10 are non-uniformly disposed so that bristles on inner surfaces 11 of said tines 3 are shorter than the bristles on said outer surfaces 12 of said tines. The diameter 13 of said bristles ranges from 0.0025 to 0.0050 inch. The metal wires 9 are twisted to a pitch which causes the brushes to have approximately 15 to 100 bristles per radial (360°) turn.

The mascara application system of the invention enables uniform application of mascara to upper and lower eyelashes. The user simply positions her eyelashes between the upper and lower applicators affixed to the stationary tines. The wand is rotated upward about a quarter turn, and the lower applicator applies mascara to the lower lashes, and the upper applicator to the upper lashes. The two applicators together act to curl the lashes. The stationary tines eliminate the clumsiness involved in opening and closing tines, and further reduce the chance of poking the eye or causing other damage.

The mascara wand of the invention can also be used to apply mascara in the usual fashion, to the lower lashes and to provide touch ups.

We claim:

1. A device for applying mascara to the eyelashes comprising, in combination:

a) a wand having at one end thereof a single stem and at the other end a plurality of stationary tines b) a plurality of applicator members corresponding to the number of tines, wherein one applicator member is affixed to each tine and the distance between the applicator members on adjacent tines is 0.10 to 0.50 inch.

2. The device of claim 1 wherein the number of tines is two.

3. The device of claim 2 wherein the applicator member is selected from the group consisting of a brush, a comb, and combinations thereof.

4. The device of claim 3 wherein both applicator members are brushes.

5. The device of claim 4 wherein the brushes are formed by a central core formed of twists made from a twisted metal wire.

6. The device of claim 5 wherein the bristles of said brush are disposed in a non-uniform manner between the twists of the twisted metal wire such that the bristles which are disposed on the inner surface of said tines are substantially shorter than the bristles which are disposed on the outer surfaces of said tines.

7. The device of claim 6 wherein the bristles comprise approximately 15 to 100 bristles per radial turn.

8. The device of claim 7 wherein the bristles are approximately 0.0025 to 0.0050 inch in diamater.

9. The device of claim 3 wherein one applicator member is a brush and one applicator member is a comb.

10. The device of claim 3 wherein one applicator member is a brush and one applicator member is a foam.

11. The device of claim 3 wherein the single stem is approximately 1 to 2 inches in length.

12. The device of claim 3 wherein the tines are approximately 0.1 to 1.0 inch in length.

13. The device of claim 12 wherein the applicator members are approximately 0.5 to 1.5 inch in length.

14. The device of claim 1 wherein the distance between the applicators is approximately 0.25 inch.

15. A mascara application system comprising, in combination:

a) a reservoir for mascara containing one opening, b) a closure for said reservoir, said closure having an inner surface and an outer surface, c) a wand having a proximal end comprised of a single stem which is affixed to the inner surface of said closure, and a distal end comprised of a plurality of stationary tines, and d) a plurality of applicator members corresponding to the number of tines, wherein one applicator is affixed to each tine, and the distance between the applicator members on adjacent tines is 0.1 to 0.5 inch.

16. The mascara application system of claim 15 wherein the number of tines is two.

17. The mascara application system of claim 16 wherein the applicator member is selected from the group consisting of a brush, a comb, and a foam.

18. The mascara application system of claim 17 wherein both applicator members are brushes.

* * * * *